US010953284B2

(12) United States Patent
Swoboda et al.

(10) Patent No.: US 10,953,284 B2
(45) Date of Patent: Mar. 23, 2021

(54) APPARATUS AND METHOD FOR CONTROLLING FLUID PROPULSION

(71) Applicants: Marek Swoboda, Philadelphia, PA (US); Michal Swoboda, Philadelphia, PA (US)

(72) Inventors: Marek Swoboda, Philadelphia, PA (US); Michal Swoboda, Philadelphia, PA (US)

(73) Assignee: Amphi Americas LLC, Philadelphia, PA (US)

( * ) Notice: Subject to any disclaimer, the term of this patent is extended or adjusted under 35 U.S.C. 154(b) by 83 days.

(21) Appl. No.: 16/556,300

(22) Filed: Aug. 30, 2019

(65) Prior Publication Data

US 2020/0070006 A1 Mar. 5, 2020

Related U.S. Application Data

(60) Provisional application No. 62/765,626, filed on Sep. 4, 2018.

(51) Int. Cl.

| | |
|---|---|
| ***A63B 31/11*** | (2006.01) |
| ***A63B 35/12*** | (2006.01) |
| ***A63B 35/02*** | (2006.01) |

(52) U.S. Cl.

CPC ..... *A63B 35/12* (2013.01); *A63B 31/11* (2013.01); *A63B 35/02* (2013.01)

(58) Field of Classification Search

CPC ..... A63B 31/11; A63B 35/02; A63B 35/12

See application file for complete search history.

(56) References Cited

U.S. PATENT DOCUMENTS

| | | | | |
|---|---|---|---|---|
| 3,635,188 | A * | 1/1972 | Rutkowski | A63B 35/12 440/6 |
| 4,938,722 | A * | 7/1990 | Rizley | B63H 20/007 440/6 |
| 6,341,993 | B1 * | 1/2002 | Lalli, Jr. | A63B 31/11 114/315 |
| 6,375,530 | B1 * | 4/2002 | Earl | A63B 31/08 114/315 |
| 10,071,289 | B1 * | 9/2018 | Robinson | B63B 32/10 |

* cited by examiner

*Primary Examiner* — Stephen P Avila

(74) *Attorney, Agent, or Firm* — Keeley DeAngelo LLP; W Scott Keeley

(57) ABSTRACT

A system, methods and apparatus for powered monofin that propels a swimmer through water uses one of two modes of power: 1. An electric-assist mode, in which the propulsor responds to a swimmer's kick by multiplying the work of the swimmer; 2. Inverse mode, in which the propulsor deactivates when the swimmer is working. In this mode, propulsion is inversely related to the work of the swimmer. As the swimmer does more work, power from the monofin is reduced, to a predetermined, average level of propulsion. As the swimmer does less work propulsion increases to the predetermined level.

17 Claims, 15 Drawing Sheets

100

100

APPARATUS AND METHOD FOR CONTROLLING FLUID PROPULSION

TECHNICAL FIELD

The present disclosure relates to swimming frameworks with driving mechanisms operated by the swimmer or by a motor; and to swim fins, flippers or other swimming aids held by or attachable to the hands, arms, feet or legs; and to other apparatuses for converting muscle power into propulsive effort using hand levers, cranks, pedals, or the like, e.g. water cycles, boats propelled by boat-mounted pedal cycles for propelled drive.

BACKGROUND

Personal underwater vehicles designed for water sports, such as diver propulsion vehicles (DPV), use electric propulsors and some type of a handle, grip or hook-up mechanism to mechanically connect the diver/swimmer to the vehicle. Speed is controlled by dials, switches or manual throttle mechanisms.

"Sea scooters" are handheld, battery-powered underwater-sports devices that can tow a person through the water. They may be attached to lower limbs and used as pushing devices.

A monofin is a type of swim fin typically used in underwater sports such as fin-swimming, free-diving and underwater orienteering. Resembling a fish's tail fin, it consists of single or linked surfaces attached to both of the diver's feet. Monofins are used to convert muscle power into propulsive work.

To use a monofin a person inserts both feet into the fin's foot openings and swims with a dolphin kick, which is a power stroke of the legs, with the feet thrust rearward.

In assistive technology (electric-assist), a sensor detects cadence or torque and indicates to a controller to accelerate. With cadence-sensing, a sensor on the main housing of an apparatus picks up movement of a magnet attached to the moving parts of the apparatus, and communicates with a motor to turn on.

Torque sensors measure the force placed on a moving part of an apparatus, in this case a fin. Force on the monofin is communicated to the torque sensor to tell it there activate to assist human work.

A MOSFET transistor (Metal Oxide Semiconductor Field Effect Transistor) is a commonly used semiconductor device for switching and amplifying electronic signals in electronic devices. A magnetic switch is used to switch electronics while allowing the switch to remain in an enclosed environment. An example of a magnetic switch is a reed switch wherein a magnet outside of the enclosed environment causes a flexible member to move and close a normally-open electrical contact or to move and open a normally-closed electrical contact.

A sensor is an apparatus for measuring input from an input device. An input device may include light, heat, magnetic material pressure or proximity.

SUMMARY

A powered monofin that propels a swimmer through water uses one of two modes of power: 1. An electric-assist mode, in which the propulsor responds to a swimmer's kick by multiplying the work of the swimmer; 2. Inverse mode, in which the propulsor deactivates when the swimmer is working. In this mode, propulsion is split between the swimmer and the propulsor. As the swimmer does more work, power from the fin is reduced to a predetermined, average level of propulsion. As the swimmer does less work, propulsion increases to the predetermined level. One skilled in the art understands that the apparatus may work with a maximum of propulsion and minimum of effort on the part of the swimmer as well as a maximum effort on the part of the swimmer with no propulsion from the propulsor.

Through the use of a switch that the swimmer activates via foot action, the apparatus can also propel a swimmer in reverse. Movement of one's heels together engages a switch for changing direction. The switch reverses the direction of the propulsor.

A proximity sensor on the embodiment's power unit senses fin movement by receiving signals from a magnetic tag on the monofin. It senses distance as well as the rate of change of the distance between magnetic tag and sensor; in this way the deflection and rate of deflection of the fin can be measured, and translated to force exerted by the swimmer on the fin.

The sensor activates a microcontroller which activates a propulsor, delivering propulsion in relation to the work of the swimmer. The more work the swimmer delivers, the greater the thrust generated by the propulsor.

A magnetic tag on the fin sends signals to the sensor describing flexion of the fin and therefore the human force on the fin. The sensor is disposed on the housing of the power unit.

The relationship between the sensor reading and the calculated force applied to the fin is established with the understanding of the properties of the specific fin materials and design. The work exerted by the user, also referred to as the calculated force applied to the fin, is derived from the proximity sensor output by the following equation:

$$F=R(S)$$

where F is the force applied to the fin, R is the flexion, and S is the distance measured by the proximity sensor. The following two examples demonstrate example applications of the formula to control the RPM of the propulsor in response to the work exerted by the user.

In a work-based application:

1. The distance measured by the proximity sensor (also referred to as fin flexion (S)) is measured as $S_1$ at time $t_1$ and $S_2$ is measured after an interval, delta t at time $t_2$
2. The corresponding forces $F_1$ and $F_2$ are established using the relationship $RF_1=RS_1$; $F_2=RS_2$
3. The distance the fin has moved during delta t is calculated $x=S_2-S_1$
4. The average force is calculated $F_{ave}=(F_1+F_2)/2$
5. The average work is calculated $W=F_{ave}*x$
6. Where $A_n$ is a predetermined constant and n is a natural number, the thrust or RPM of the propulsor, for the time interval delta t, is calculated as a polynomial $T=A_n*W^n \ldots A_1*W^1$
7. The procedure is repeated for another interval of delta t.

In a power-based application:

1. The distance measured by the proximity sensor (also referred to as fin flexion (S)), is measured as $S_1$ at time $t_1$; and $S_2$ is measured after an interval, delta t at time $t_2$.
2. The corresponding forces $F_1$ and $F_2$ are established using the relationship $RF_1=RS_1$; $F_2=RS_2$
3. The distance the fin has moved during delta t is calculated $x=S_2-S_1$
4. The average force is calculated $F_{ave}=(F_1+F_2)/2$ 5. The average power is calculated $P=F_{ave}*x/\text{delta } t$
6. The thrust or RPM of the propulsor, for the time interval delta t, is calculated as a polynomial $T=A_n*P^n \ldots A_1*P^1$
7. The procedure is repeated for another interval of delta t Where $A_n$ is a predetermined constant and n is a natural number.

In another embodiment the thrust or RPM delivered by the propulsor is determined by the signal from the proximity sensor, by a relationship-linking thrust (T) to the amplitude of the sensor response S(t) at a given moment $t_m$ by the following equation:

$$T = F\left[\frac{d^n S(t)}{dt^n}\right]_{t=t_m}$$

where F is any monotonic or step function of $(dS^n/dt^n)$ or combination of monotonic and step functions; n=(0, 1 . . . 10), t is a time variable; $t_m$ is the time of the measurement; T is the thrust of the propulsor; and S is the sensor-signal strength as a function of time.

Thrust at any given moment $t_m$ is equal to the value of function F at $t_m$. F can be any monotonic or step function or any combination of monotonic or step functions. The argument of function F can be any n'th-time derivative of S including n=0 which represents S(t). Thrust T in this equation can be replaced with RPM, power, electric current measured on the input of the motor, or any parameter which is in relationship to thrust.

In another embodiment, the relationship between load on the fin and flexion of the fin is described by the Euler-Bernoulli equation:

$$\frac{d^2}{dx^2}\left(EI\frac{d^2 w(x)}{dx^2}\right) = q(x)$$

where q is the force per unit length (also referred to as distributed load) on the fin; E is the elastic modulus of the fin; I is the second moment of area of the fin's cross section, w(x) is the displacement of the fin; and x is the distance from the binding.

Solving for w(x) gives the opportunity to find displacement of the fin at any distance x from the binding for any load distribution q(x) on the fin. The specific distribution of q(x) can be experimentally obtained by testing a fin as it is moved in water.

Example solutions for two specific q distributions are given below. The types of distributions are the uniform distribution and triangular distribution (https://mechanical-c.com/reference/beam-deflection-tables):

In a uniform distribution case (q=constant for all x) the deflection w(x) is described by the following equation:

$$w(x) = \frac{qx^2}{24EI}(6L^2 - 4Lx + x^2)$$

For triangular distribution, q changes in a linear fashion between $q_{max}$ and 0, $q_{max}$ and is applied on the edge of the binding and is described in the following equation:

$$w(x) = \frac{q_{max}x^2}{120LEI}(10L^3 - 10L^2x + 5Lx^2 - x^3)$$

The relationship between the loading level q and displacement of the fin w at any given point x. w=Z(q) may be determined, understanding that x is the distance from the binding edge.

If the displacement sensor is placed at $x=x_0$ then its signal S will be proportional to w $(x_0)$; thus by measuring S one can assess q or $q_{max}$.

The the relationship between S and q. S (t)=G(q,t) where S is the sensor signal amplitude and G a function of q and t (load and time) may therefore be determined.

Ultimately the thrust-load relationship can be established by substituting S(t) in equation [1] with G(q) as in the following equation:

$$T = F\left[\frac{d^n G(q, t)}{dt^n}\right]_{t=t_m}$$

Where F is any monotonic or step function of $(dG^n/dt^n)$ or combination of monotonic and step functions, n=(0, 1 . . . 10), t is a time variable, $t_m$ is the time of the measurement, T is the thrust of the propulsor, and S is the sensor signal strength as a function of time.

In all of the embodiments, the microcontroller's firmware controls the propulsive power; reads inputs from the sensors; records and stores sensor data; and communicates with the embodiment's app.

A charger is electronically coupled to a battery, which supplies electronic power to a MOSFET switch. A magnetic switch is a primary power switch that turns on the MOSFET switch. The magnetic switch and MOSFET switch power a microcontroller. An inertial measurement unit (IMU) sends signals to the microcontroller relating to the inertia of the housing the apparatus. The microcontroller powers an electronic speed controller (ESC). A reverse switch signals the microcontroller to reverse the direction of the propulsor.

An app receives input from the swimmer independent of the use of the apparatus while swimming. The app communicates with the firmware installed on the microcontroller inside the apparatus. These instructions are transmitted to the microcontroller by a wireless link.

With this app a user may adjust the settings related to the operation of the apparatus; change aspects of the link between propulsor and user; activate onboard recording; retrieve recorded data from the onboard controller; and view recorded data as a visualization (e.g. 3D underwater path). The app records movement-related data: x, y and z-coordinate position; time of day, atmospheric, and underwater pressure, temperature, and water salinity.

The power pack of the embodiment may be detached for using the monofin unpowered.

The embodiment's monofin has a circular opening cut into it so that the fin's movement does not interfere with the propulsor.

DESCRIPTION

Figure 1:
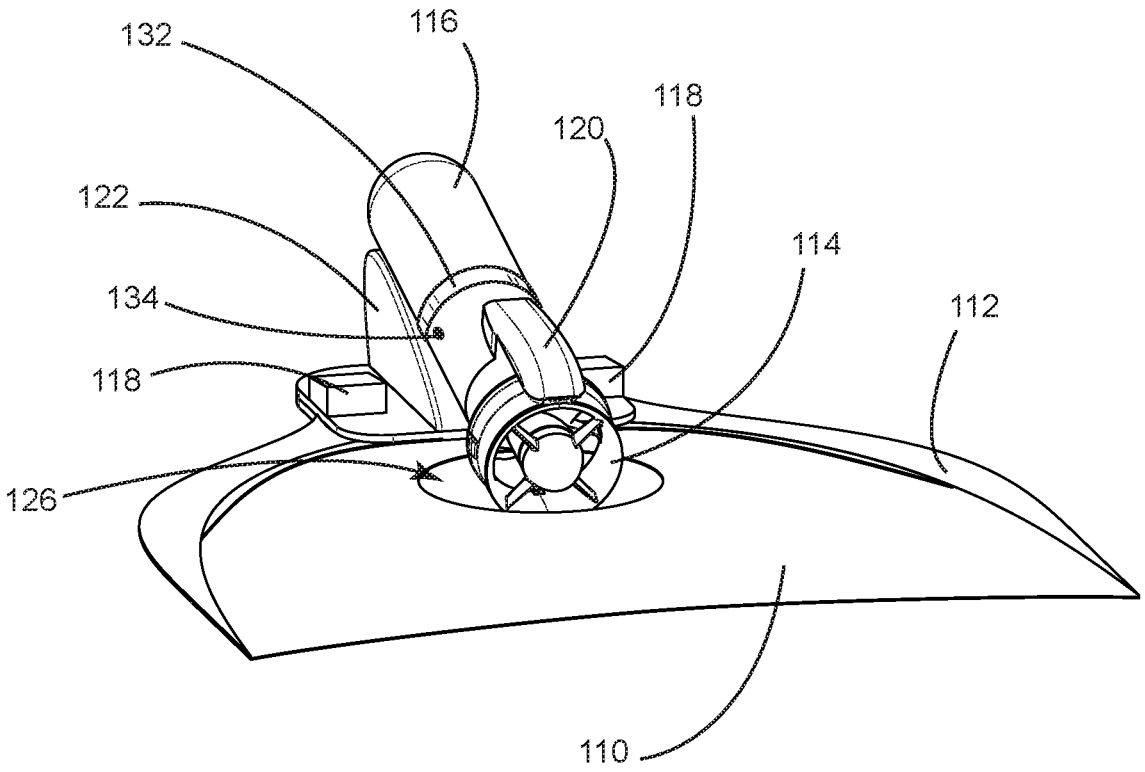
FIG. 1 is a front perspective view of the present embodiment.
Figure 2:
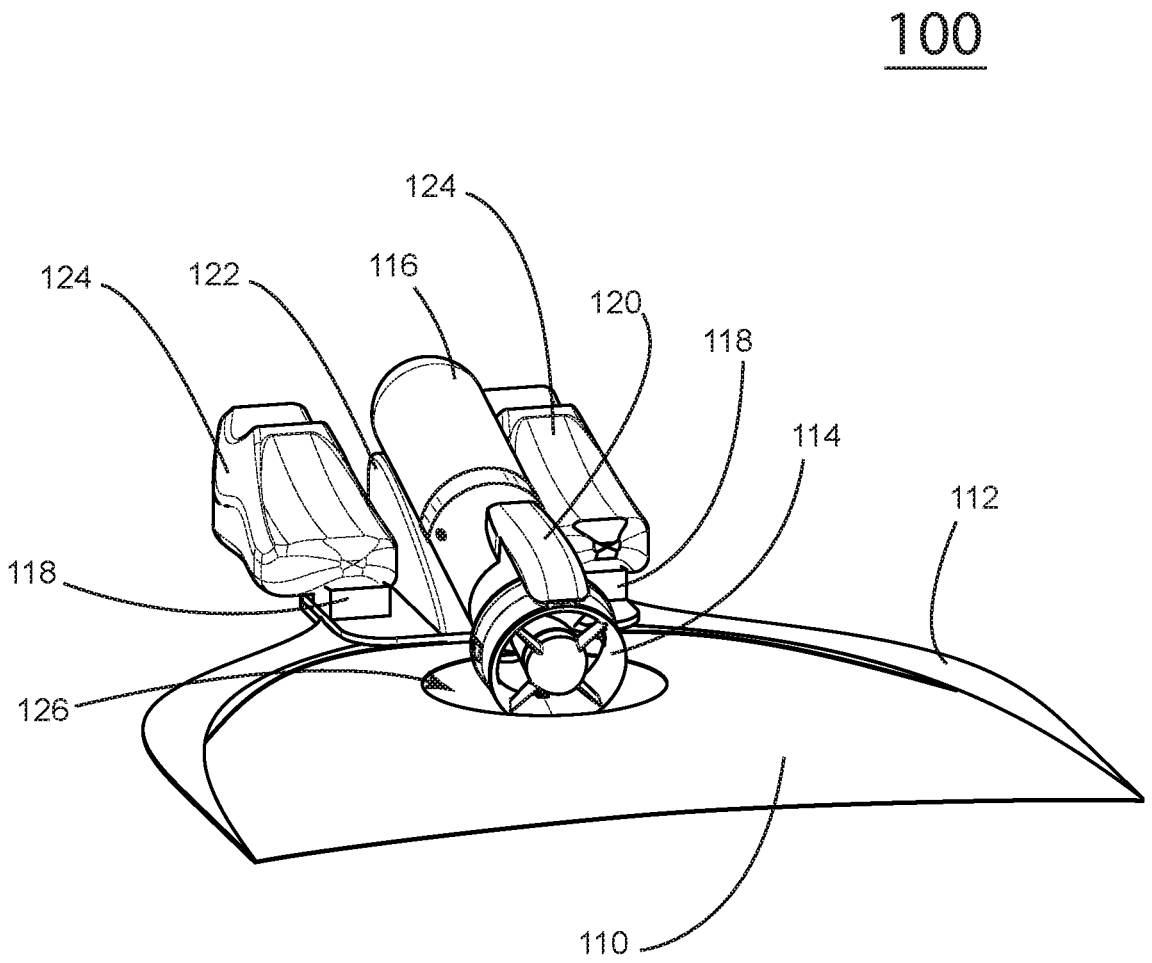
FIG. 2 is a front perspective view with shoes attached.

FIGS. 1 and 2 show an example embodiment 100 of a monofin 100 for propelling a swimmer through water. The monofin 110 is engaged with a housing-support structure 122 that supports a housing 116 for containing electronics and an electric power source. In some embodiments the housing has a structure 120 for mounting a propulsor 114. The propulsor 114 is configured to fit through a circular opening 126 in the monofin 110. A main power switch 132 is a mechanism that employs a magnet or magnetic material; when moved to cover a magnetic receiver 134, a magnetic switch inside the housing is engaged, which turns on the electronic system in the electronic housing 116. Magnetic switches are common in the industry and are often used to communicate through a sealed barrier. One skilled in the art understands the need to seal off electronics and electronic power sources from a wet environment.

Toe clips 118 accept shoes with mating clips. Shoes 124 (FIG. 2) attach to the monofin by way of clips 118 and mating clips embedded in the shoes 124. One skilled in the art is familiar with similar clips as used in cycling and skiing and the like. In some embodiments the monofin has stiffeners 112 that provide structural support about the edges of the fin.

Figure 3:
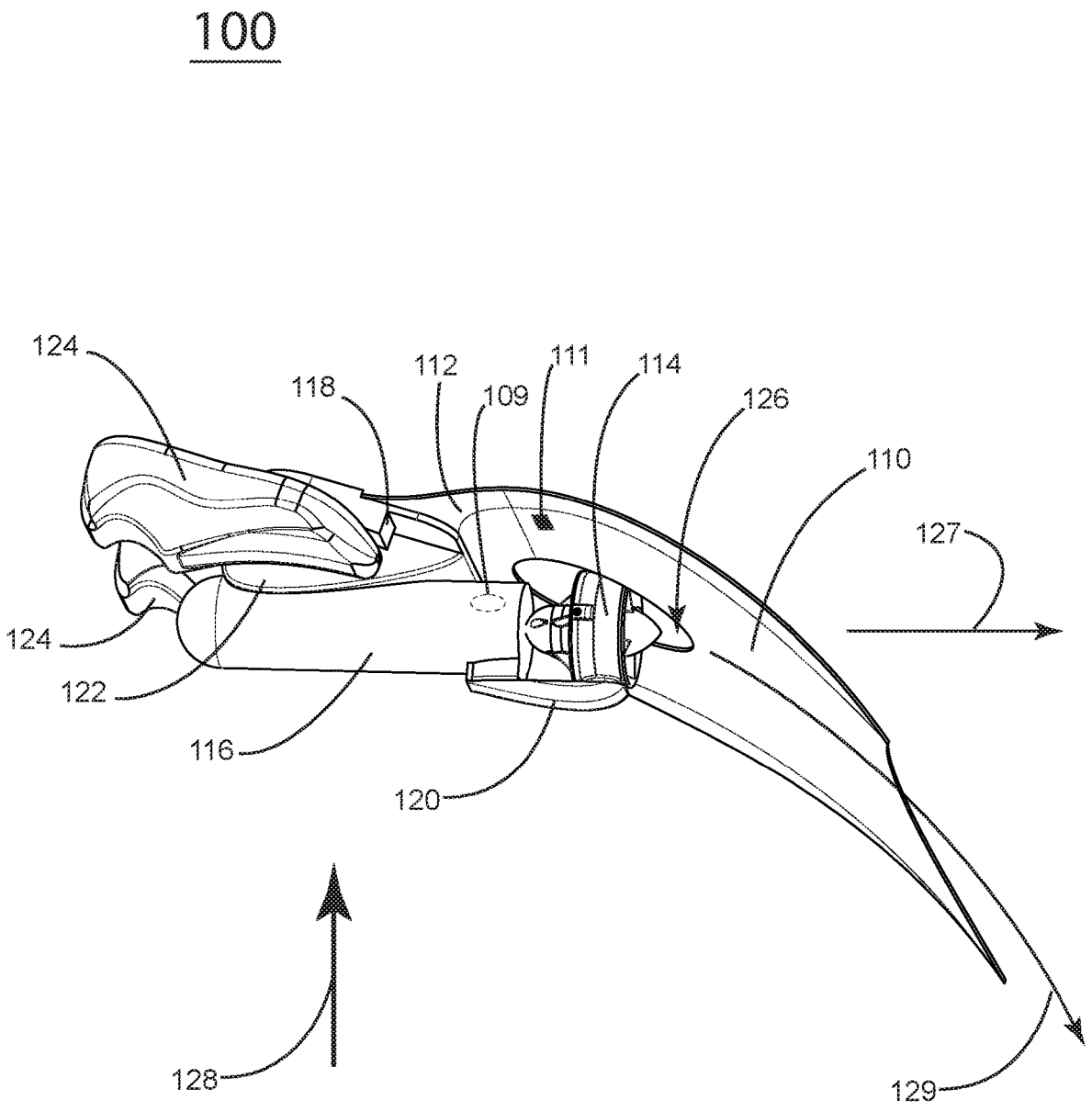
FIG. 3 is a side perspective view during an upward kick.
Figure 4:
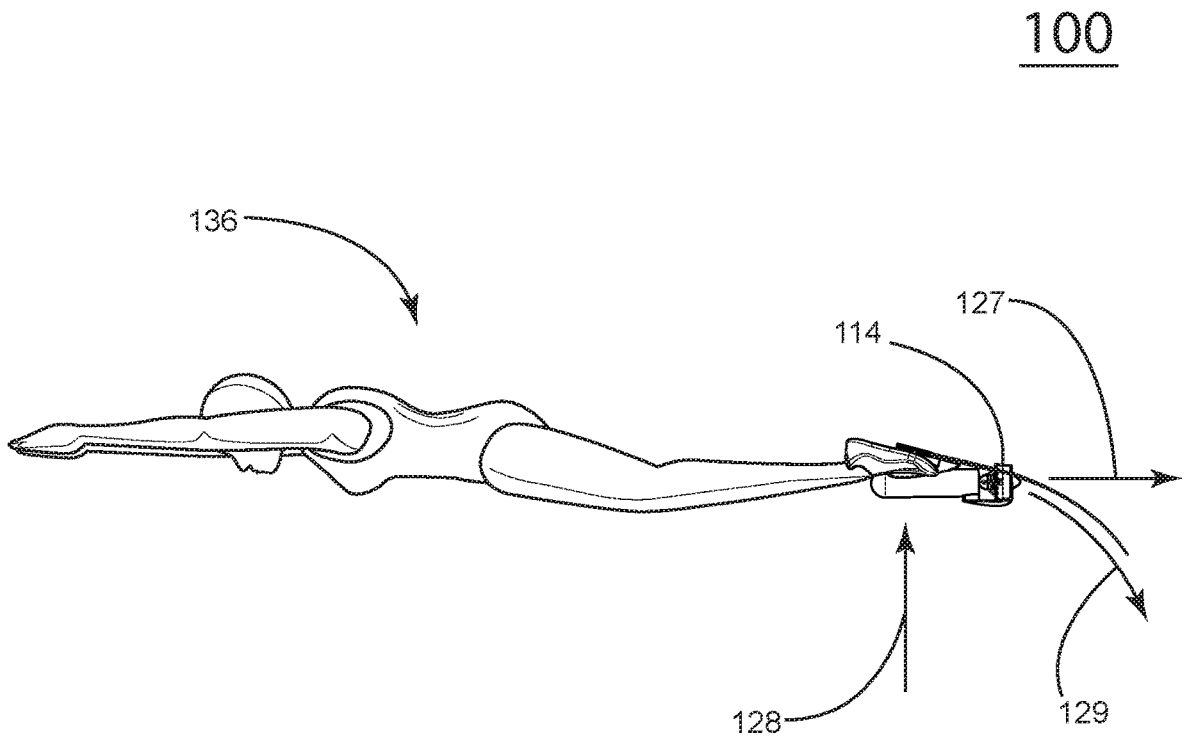
FIG. 4 is an orthographic side view of the embodiment as worn by a swimmer performing an upward kick.

FIGS. 3 and 4 show the embodiment 100 with the monofin 110 flexed as it is when a swimmer 136 kicks upward (arrow 128). Previously described reference numbers are shown for reference. As fluid through the propulsor 114 is directed through the opening 126, it can be seen that most of the thrust is directed along vector 127. One skilled in the art understands that while some of the propulsion force will be directed along the fin 110 in the direction shown by vector 129, causing some oscillation while the swimmer kicks, the resultant-force vectors propel the swimmer forward. In some embodiments a proximity sensor (109 and 111) measures the deflection of the fin.

In one embodiment, a magnetic tag 111 is affixed to the fin 110. A magnetic sensor 109 is housed in the housing 116. The magnetic sensor measures the distance between the magnetic sensor 109 and the magnetic tag 111. The proximity sensor measures both the distance between the magnetic sensor 109 and the magnetic tag 111 as well as the rate of change. One skilled in the art understands that by measuring the distance and the rate of change of the distance between magnet and sensor, the deflection and rate of deflection of the fin can be measured. The deflection and rate of deflection may be translated to force exerted by the swimmer on the fin.

Figure 5:
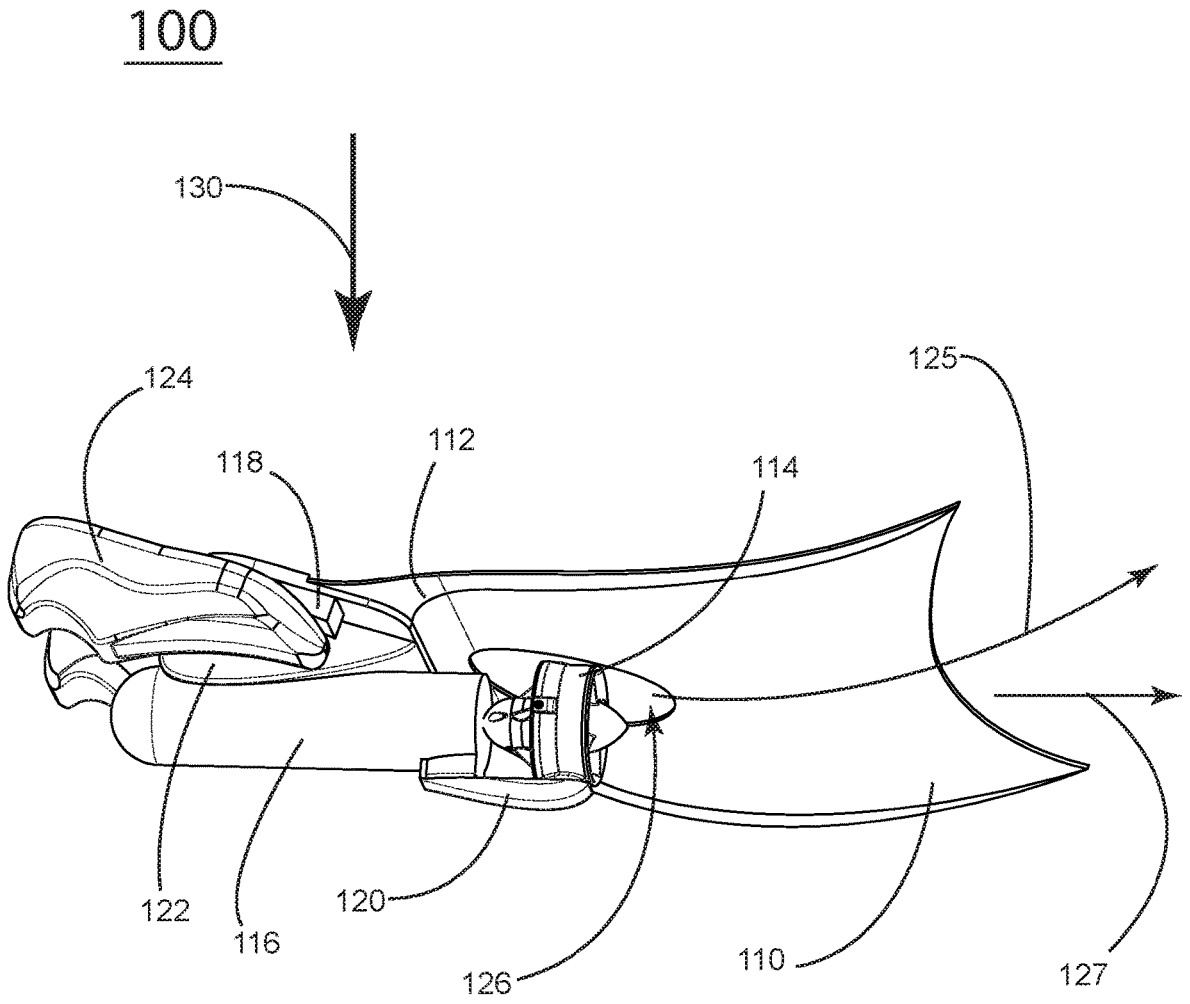
FIG. 5 is a side perspective view of the embodiment during a downward kick.
Figure 6:
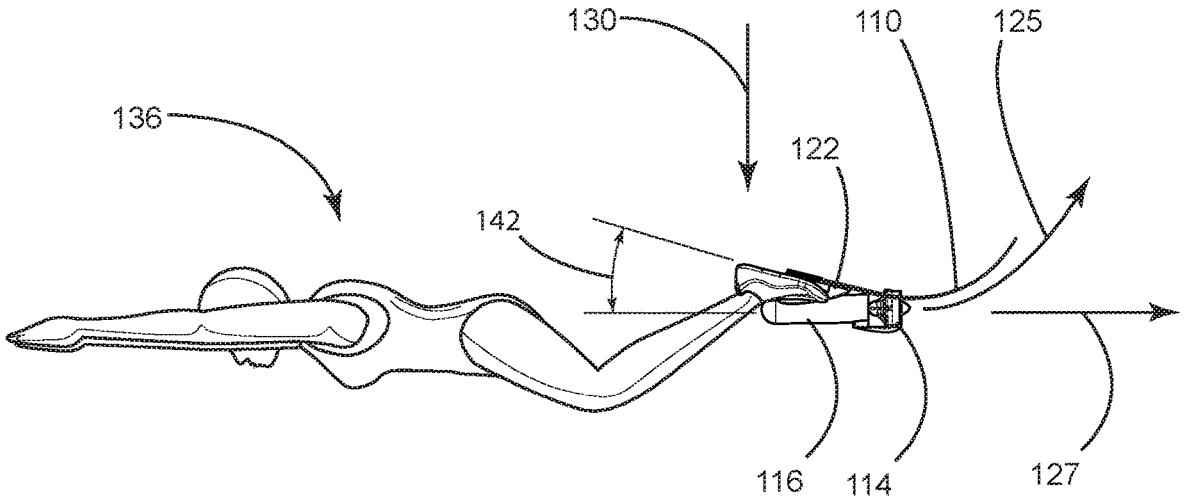
FIG. 6 is an orthographic side view as worn by a user during a downward kick.

FIGS. 5 and 6 show the embodiment 100 with the monofin 110 flexed as it is when a swimmer 136 kicks downward, arrow 130. Previously described reference numbers are shown for reference. The propulsor 114 is substantially coaxial with the housing 116. A mounting structure 122 holds the housing and thus the propulsor at an angle 142 with respect to the unflexed fin that is between 5° and 25° and more preferably between 10° and 20°.

As fluid through the propulsor 114 is directed through the opening 126, it can be seen that most of the thrust will be directed along vector 127. One skilled in the art understands that while some of the propulsion force will be directed along the fin 110 in the direction shown by vector 125, causing some oscillation while the swimmer kicks upward and downward, the resultant force vectors propel the swimmer 136 forward.

Figure 7:
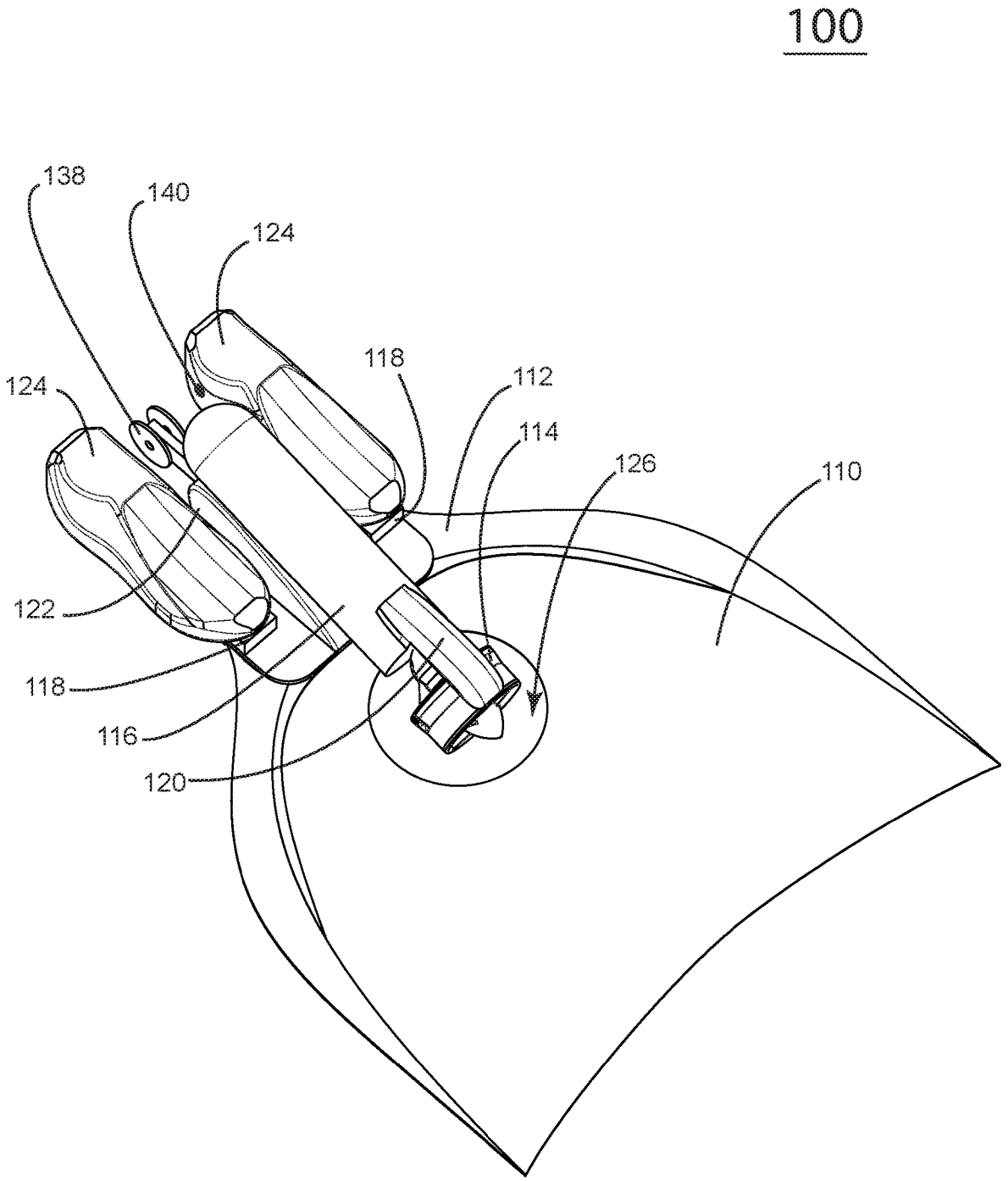
FIG. 7 is a top perspective view showing a reverse-mode switch.
Figure 8:
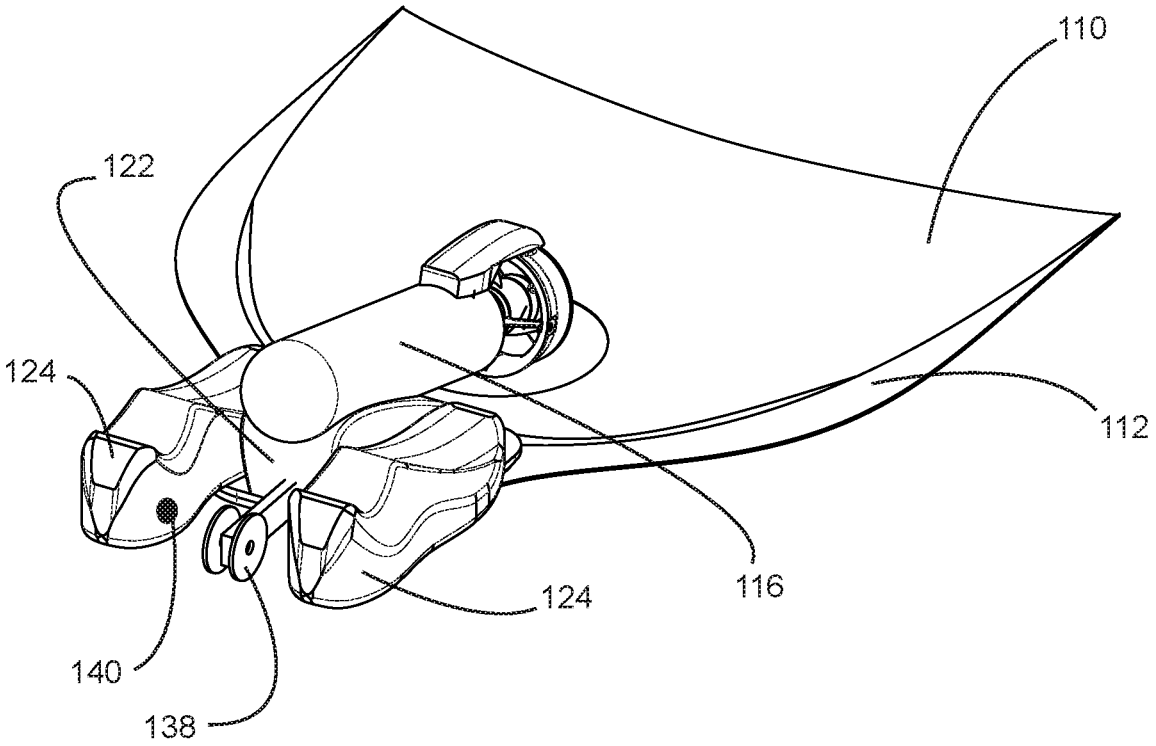
FIG. 8 is a rear perspective view of the embodiment showing the reverse-mode switch.

FIGS. 7 and 8 show a reverse-thrust switch 138 which is a magnetic receiver paired with a magnet 140 that is mounted proximal to the heel of each shoe. Moving one's heels together brings the magnets 140 in contact with the magnetic sensor 138 which in turn engages a switch in the housing 116 that reverses the direction of the propulsor 114, thus reversing the motion of the fin. One skilled in the art understands that such a magnet and magnetic sensor configuration may be used to communicate various commands to a circuit. A click-and-hold motion may communicate reverse direction while a double-click motion may communicate a high-speed reverse motion. Previously described reference numbers are shown for reference. One skilled in the art understands how the reverse-thrust switch 138 may be configured with a mechanical switch in place of a magnetic switch.

Figure 9:
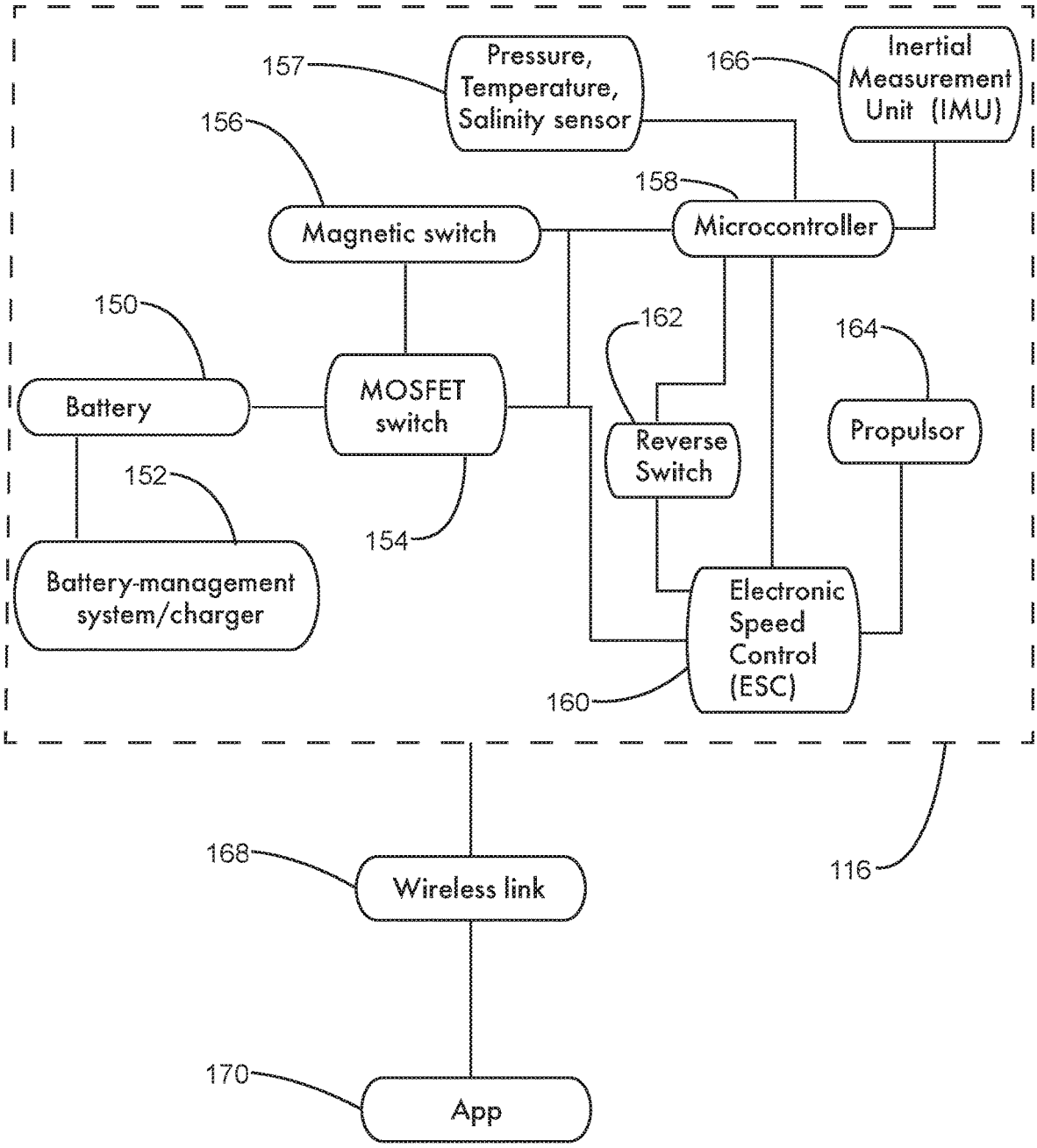
FIG. 9 is a diagram depicting the embodiment's electronics components.

The diagram of FIG. 9 shows components within the electronics housing 116 (FIG. 8). A battery-management system or charger 152 is electronically coupled to a battery 150. The battery supplies electronic power to a MOSFET switch 154. A magnetic switch 156 is a primary power switch that turns on the MOSFET switch 154. The magnetic switch 156 and MOSFET switch 154 power a microcontroller 158. A pressure, time and salinity sensor 157 sends signals to the microcontroller relating to the pressure, time and salinity of the environment. An inertial measurement unit (IMU) 166 sends signals to the microcontroller 158 relating to the inertia of the housing 116 (FIG. 8) and thus the apparatus. The microcontroller powers an electronic speed controller (ESC) 160. A reverse switch 162 signals the microcontroller 158 to reverse the ESC 160, which reverses the direction of the propulsor 164. An app 170 receives input from a user to configure the microcontroller. These instructions are transmitted to the microcontroller by a wireless link 168.

The related terms "proportionately increased speed" and "inverse proportionately increased speed" are used to describe features and functions of the apparatus of the embodiment. The term "proportionately" refers to a relation between the work exerted by the user and the thrust delivered by the propulsor. In some embodiments the relation is a monotonic function wherein "proportionally increased speed" refers to a function where the first derivative is always positive and "inverse proportionately increased speed" refers to a function where the first derivative is always negative.

In one use of the embodiment, the microcontroller 158 is configured by the app 170 to cause the Electronic Speed Controller (ESC) 160 to proportionately increase the speed of the propulsor 164 with the speed of the apparatus as measured by the inertial measurement unit (IMU) 166. In this configuration, as the user swims with relatively greater force, the propulsor adds relatively greater force, propelling the user faster.

In another use of the embodiment, the microcontroller 158 is configured by the app 170 to cause the ESC 160 to inverse-proportionately increase the thrust of the propulsor 164 with the speed as measured by the IMU 166. In this configuration, a target speed is chosen in the app 170. The target speed is uploaded to the microcontroller 158 by way of the wireless link 168. As the user swims with relatively greater force, the microcontroller 158 signals the ESC 160 to reduce the speed of the propulsor 164 until the target speed, measured by the IMU 166, is reached. As the user swims with relatively lesser force, the microcontroller 158 signals the ESC 160 to increase the speed of the propulsor 164 until the target speed, measured by the IMU 166, is reached.

In yet another use of the embodiment, the propulsor 164 is driven in a reverse direction to move the swimmer backwards. A reverse switch 162 signals the microcontroller 158 to reverse the direction of the ESC 160 to drive the propulsor 164 in reverse, thus moving the apparatus such that it pulls the user in reverse.

Figure 10:
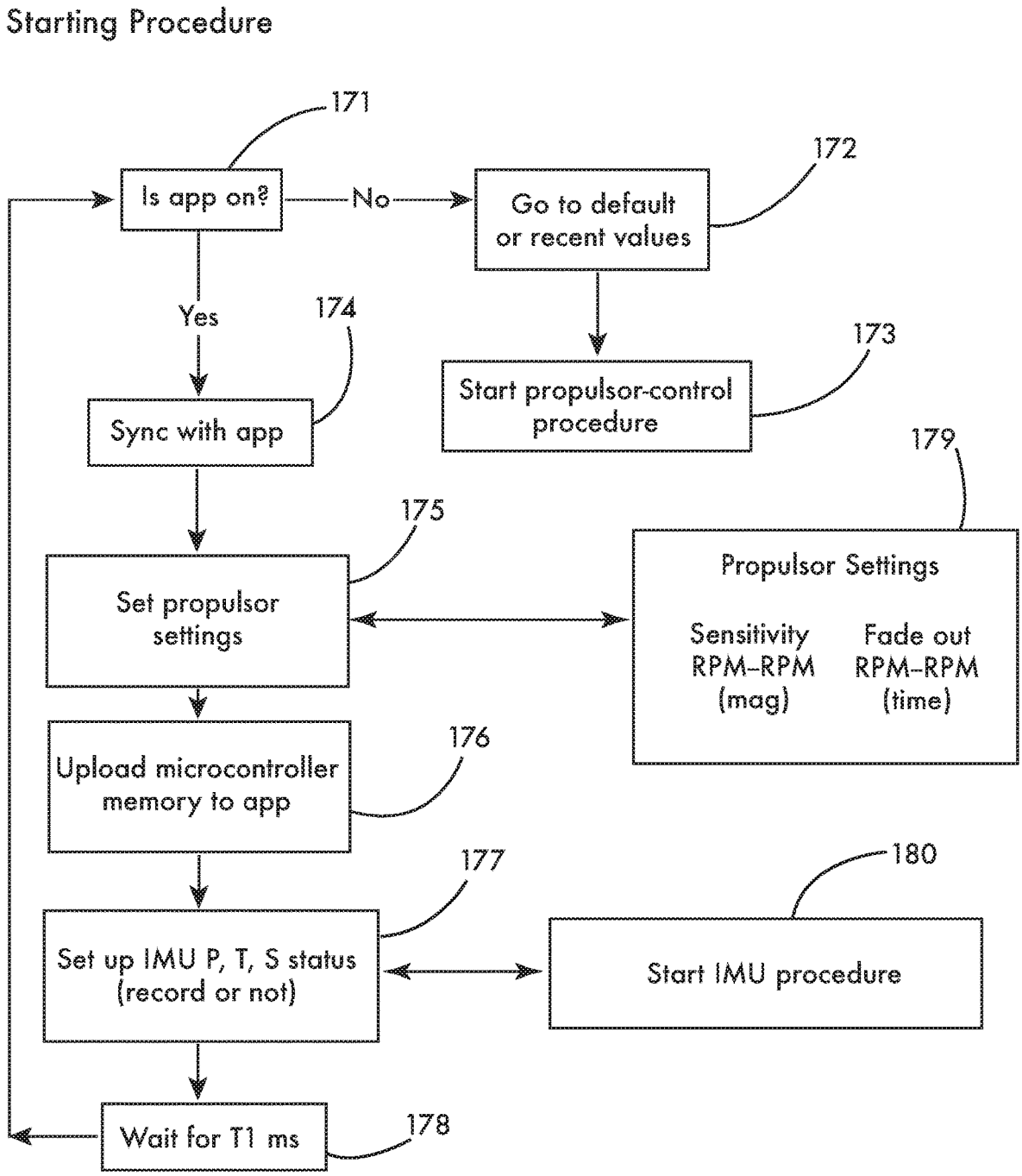
FIG. 10 is a diagram of the starting procedure.

FIG. 10 is a flowchart demonstrating a control software application, otherwise referred to as an app. The procedure begins with a binary component 171 that asks if the app is on. If the app is not on the program proceeds to default or recent values 172 and then starts the propulsor-control procedure 173. If the app is on the program proceeds sync with the app 174 and then to set the propulsor settings 175, which are stored in memory 179.

Propulsor characteristics are defined by sensitivity and fade-out. Sensitivity refers to the amount of propulsor power is given in response to sensor input as the proximity sensor measures the magnitude and frequency of flexing of the fin 110 (FIG. 3). In one embodiment the flex of the fin is measured by calculations derived from information gathered from the proximity sensor 109 and the sensed magnet 111. The program calculates the change in distance between the magnet and sensor as well as the frequency of the change. One skilled in the art understands how the two measurements can be used to determine if the user is powering their stroke with long slow strokes or short fast strokes. The amount of power exerted, or work done, is then derived from an equation based on the information.

One skilled in the art also understands that various sensors may be used to determine the work exerted by the user through the fin. In some embodiments a strain gauge is used to measure flexion of the fin.

Fade-out refers to the gradual reduction in response after a minimum reading from the IMU, signifying a cessation of kicking The cessation of kicking results in a change in propulsor RPMs. In other words, when kicking starts, propulsion starts and when kicking stops, propulsion stops gradually. The function by which propulsion stops gradually is also known as the decay. How the propulsion starts and how gradually the propulsion stops, is determined by the propulsor's settings 179.

Propulsor settings 179 are set in a propulsor-sensitivity program (FIG. 13) which are part of the starting-procedure app 175. The information relating to propulsion characteristics is setup in the app and then uploaded to the microcontroller 176. Setup of the Inertial Measurement Unit (IMU) status 177 measures Pressure (P) Temperature (T) and Salinity (S) while the app is on. The IMU status may be recorded or not recorded in the step 177. Once the IMU status is determined 177, the IMU procedure is started 180. The system continues to function until the swimmer stops kicking, at which point the system pauses for a wait time of T1 milliseconds (ms) 178 and then begins the program again at the beginning, checking if the app is on 171.

Figure 11:
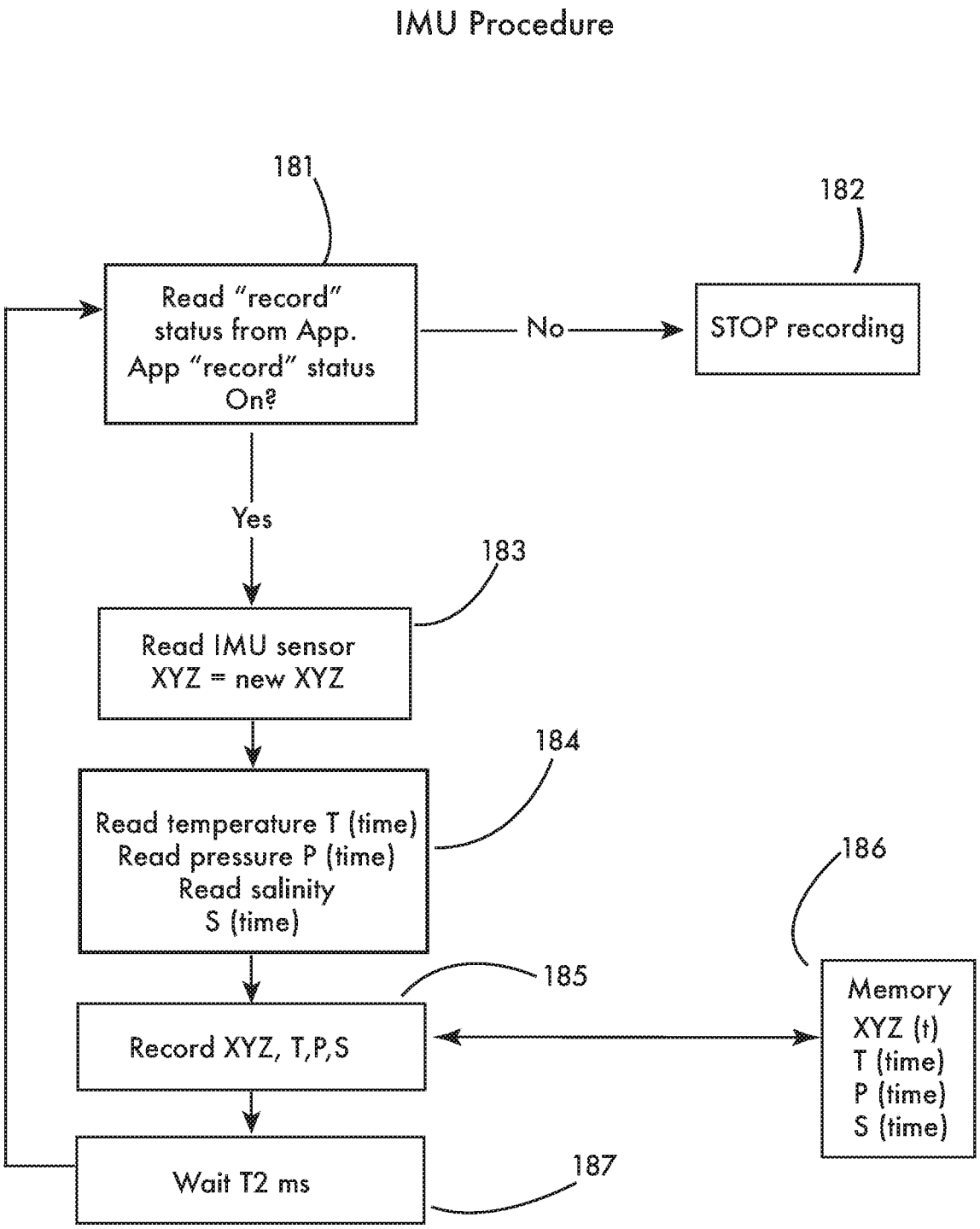
FIG. 11 is a diagram of the IMU procedure.

FIG. 11 details the IMU procedure. The program starts with a reading 181 from the Record or Not step 177 (FIG. 10). If the record status is off, the unit will not record 182. If the record status is set to ON, the unit begins recording the IMU status to memory and begins to read the IMU sensor X, Y and Z coordinates, setting a new XYZ location 183. The temperature (T), Pressure (P) and Salinity (S) are recorded along with the time of each recording 184. The XYZ coordinates and T, P, S, measurements are continuously recorded 185, and stored in memory 186. When kicking stops, the system pauses for a wait time of T2 ms 187 and then begins the program again at the beginning, checking if the record status is on 181.

Figure 12:
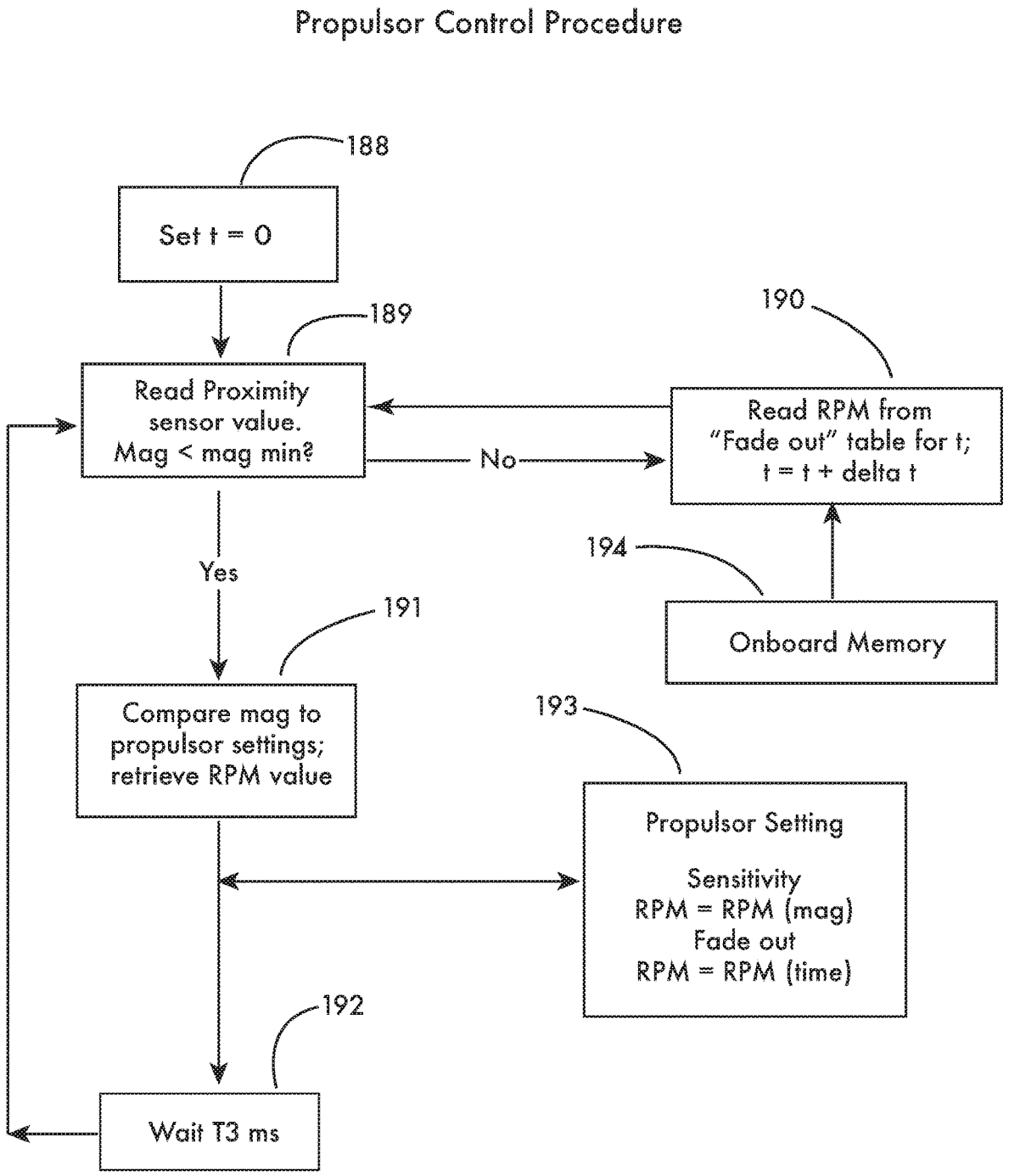
FIG. 12 is a diagram of the propulsor-control procedure.

FIG. 12 details the propulsion control procedure. The procedure begins with a start-setting time at zero (Set t=0), 188. The procedure subsequently collects a reading from the proximity sensor and reads the magnetic sensor value 189; if the reading is less than a preset minimum value the procedure compares the sensor value to propulsor settings and retrieves an RPM value, 191. With the RPM value retrieved 191, the RPM value is then compared to the Propulsor Setting Sensitivity and fade-out setting 193 and the Propulsor Setting is maintained. Following, the procedure then waits a period, measured in milliseconds (Wait T3 ms) 192 and returns to read proximity sensor value 189.

If the proximity sensor reading 189 is equal to or less than the aforementioned preset minimum the procedure reads and compares the proximity sensor reading 189 to the propulsor setting 190 and gathers the RPM information from the fade-out table and returns to the reading of the proximity sensor 189. In an example embodiment a reading for fade-out may be $$t=t+\text{delta } t$$

Where t is time and delta t is the intended change in time according to the fade-out table data. This information is gathered from the onboard memory 194.

Figure 13:
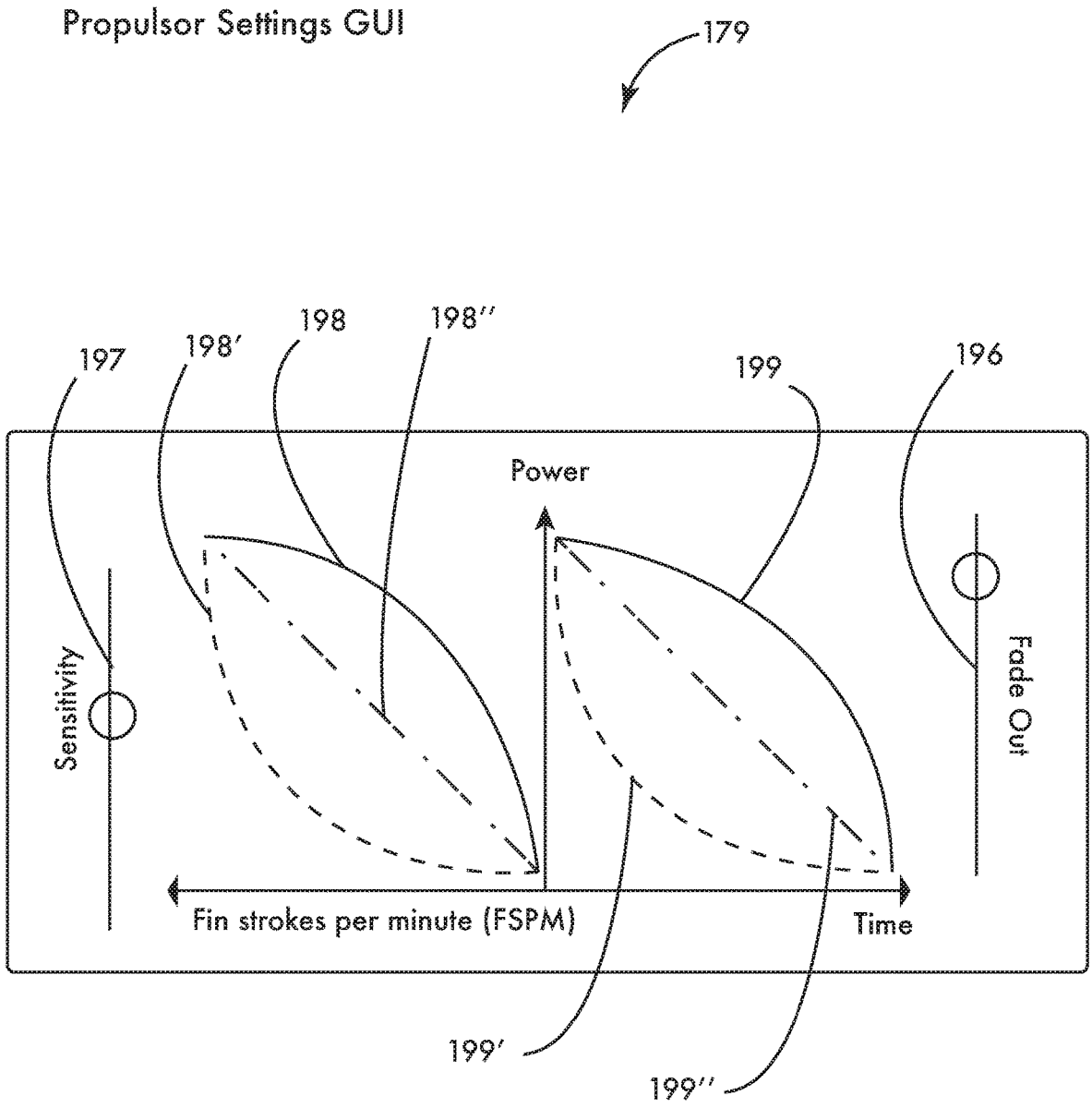
FIG. 13 depicts a graphical user interface (GUI) of the propulsor settings of an example embodiment.

FIG. 13 depicts a graphical user interface (GUI) of the propulsor settings of an example embodiment. In this example a sensitivity slider 197 allows the user to change the sensitivity 197 by sliding the graphic upward for a maximum sensitivity or downward for minimum sensitivity. The sensitivity slider 197 changes the graphic line 198 from a maximum increase in propulsor RPMs, otherwise referred to as power. A mid-range setting 198" is shown in a varied dotted line and a minimum setting 198' is shown in dashed line. A fade-out slider 196 allows the user to change the fade-out from a minimum to a maximum setting by sliding the graphic upwards or downwards. The fade-out slider 196 changes the graphic line 199 from a gradual decrease in propulsor RPMs over time 199 to a mid-range setting 199" rapid decrease in propulsor RPMs over time, shown in dashed line 199'.

In an example embodiment of the propulsor-settings GUI 179, shown in FIG. 13, if the sensitivity slider 197 were set to create the line 198, as fin strokes per minute decrease, the power decreases. In this setting, the propulsor RPMs increase as the FSPM increases. This mode augments the user's work by increasing propulsor RPMs as the user kicks harder and decreases propulsor RPMs as the user kicks less. Such a rapid response may be useful when performing specific tasks close to an underwater obstacle wherein the user may want to stop rapidly. A more gradual sensitivity may be useful when moving about or traveling a distance.

In this example in FIG. 13, a setting denoted by the Fade Out slider 196 that creates the line 199' would stop the propulsor almost immediately after the user stopped kicking, as noted by the procedure (Wait T3 ms) 192 (FIG. 12). In another example, with the fade-out setting to the graphic line 199, the propulsor RPMs would continue after the user stopped kicking, and fade out over time.

Figure 14:
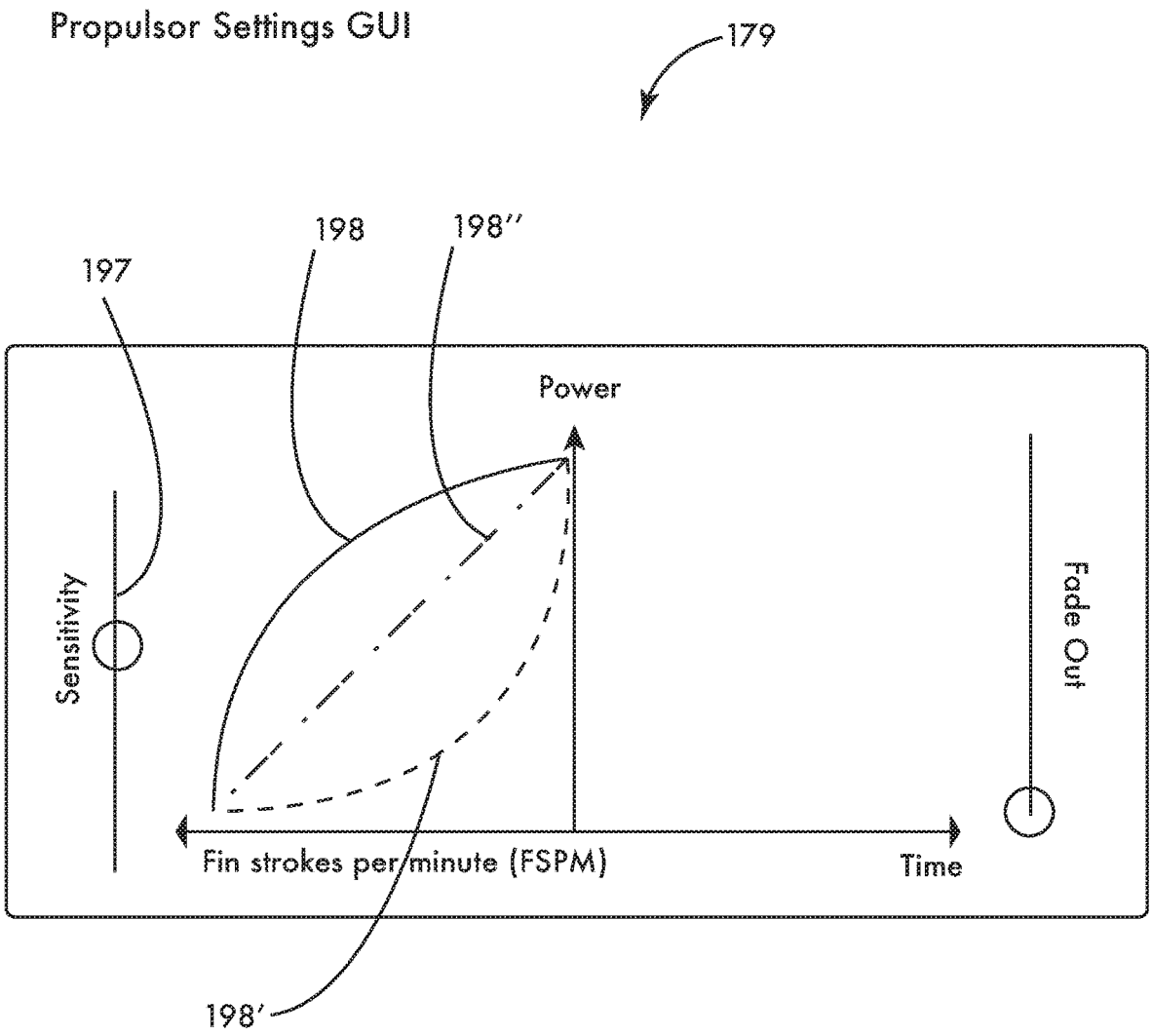
FIG. 14 depicts a graphical user interface (GUI) of the propulsor settings of an example embodiment.

In FIG. 14, n an example embodiment of the propulsor settings GUI 179, if the sensitivity slider 197 were set to create the line 198, the propulsor RPMs would decrease gradually as the fin strokes per minute (FSPM) increased, and the propulsor RPMs would increase as the FSPM decreased. In this example, the Fade Out function is disabled. Lines 198' and 198" show examples of a faster response of the sensitivity. For example the setting shown by line 198' would produce a very rapid decrease in propulsor RPMs as FSPM increased. This mode may be useful in traveling a distance with the intent to conserve power while maintaining a maximum speed. As the user exerts more power, the propulsor contributes less; as the user exerts less power, the propulsor contributes more, thus keeping a relatively steady velocity. One skilled in the art understands that maintaining a constant velocity in water is relative to the movement of the water and that any measurement of velocity in water will vary about a range of velocities but may be kept relatively constant within such a range.

Figure 15:
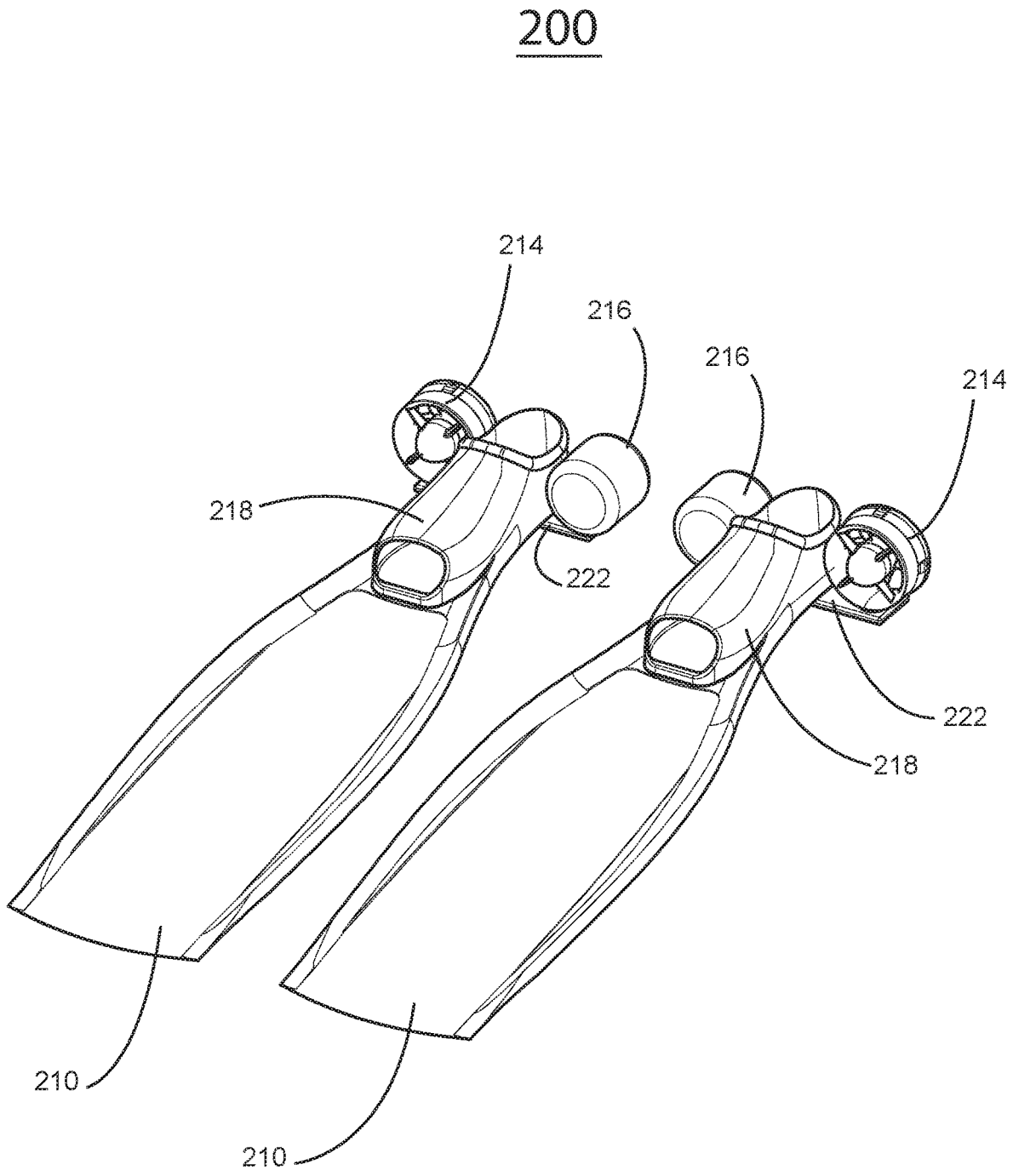
FIG. 15 is a second iteration of the embodiment, this one with two fins.

A second iteration 200 of the apparatus is shown in FIG. 15. A pair of fins 210 are each formed with an engagement for the user's feet 218 upon which are mounted a structural base 222 that supports an electronics housing 216 and a propulsor 214. One skilled in the art understands that the pair of fins, the electronics housing and the propulsor functions of iteration 200 may be controlled in a similar manner to that of iteration 100.

These embodiments should not be construed as limiting.

The invention claimed is:

1. An apparatus for propelling a body through water comprising:

at least one propulsor; and a power source with a microcontroller;

a housing, fixedly engaged with said at least one propulsor, for containing the power source, microcontroller, and control circuitry; and said housing and at least one propulsor fixedly engaged with at least one fin; and at least one shoe engaged with said at least one fin; wherein the user's feet, when inserted into the at least one shoe, move to control the fin; and the action of the fin-movement causes said power source to activate the at least one propulsor, propelling the user through the water while swimming.

2. The apparatus of claim 1, further comprising:

a binding engaged with said at least one fin; and at least one shoe engaged with said at least one binding.

3. The apparatus of claim 1, the at least one fin further comprising:

a permeable region proximal to the at least one propulsor, wherein fluid passing through the propulsor passes through said permeable region in the at least one fin while the fin is flexed during swimming.

4. The apparatus of claim 1 further comprising:

a primary switch comprising:

a bracket having an input device that is slidably engaged with the exterior of said housing; and a sensor on the interior of said housing engaging with input from said input device when said bracket is slid proximal to said sensor; wherein the power source is electronically engaged with said control circuitry to turn on the apparatus when said input device is slid proximal to said sensor.

5. The apparatus of claim 1 further comprising:

reverse-control switch comprising:

a sensor engaged with said housing proximal to said at least one shoe; and said sensor electrically coupled with a switch; and an input device fixedly engaged with said at least one shoe; and said switch electronically engaged with said control circuitry to reverse the direction of said at least one propulsor when switched on; wherein moving said at least one shoe and thus said input device, fixedly engaged with said at least one shoe, proximal to said sensor, engages said switch, which initiates the control circuitry to drive the at least one propulsor in a reverse direction, moving the user backwards.

6. The apparatus of claim 1 further comprising:

a reverse-control magnetic switch comprising:

a magnetic sensor engaged with said housing proximal to said at least one shoe; and said magnetic sensor electrically coupled with a switch; and a magnet fixedly engaged with said at least one shoe; and said switch electronically engaged with said control circuitry to reverse the direction of said at least one propulsor when switched on; wherein moving said at least one shoe and thus said magnet fixedly engaged with said at least one shoe, proximal to said magnetic sensor, engages said switch, which initiates the control circuitry to drive the at least one propulsor in a reverse direction, moving the user backwards.

7. The apparatus of claim 1 further comprising:

a proximity sensor engaged between said fin and said housing; and said proximity sensor senses the change in the distance between said fin and said housing; and a processor in said housing for calculating the work exerted on said at least one fin based on the change in the distance between said fin and said housing, by the equation:

$$F=R(S)$$

where F is force applied to said fin;

and R is the flexion of said fin; and

S is the change in the distance between said fin and said housing as measured by said proximity sensor; and an electronic speed controller; and said electronic speed controller is configured to increase revolutions per minute of the at least one propulsor when the processor calculates an increase in work exerted on the at least one fin, and to decrease the revolutions per minute of the at least one propulsor when the processor calculates a decrease in work exerted on the at least one fin; wherein work exerted by the user controls the revolutions per minute of the at least one propulsor.

8. The apparatus of claim 1 further comprising:

a proximity sensor engaged between said fin and said housing; and said proximity sensor senses the rate of change of the distance between said fin and said housing; and a processor in said housing for calculating the work exerted on said at least one fin based on the rate of change of the distance between said fin and said housing, by the equation:

$$F=R(S)$$

where F is force applied to said fin;

and R is the flexion of said fin; and

S is the rate of change of the distance between said fin and said housing as measured by said proximity sensor; and an electronic speed controller; and said electronic speed controller is configured to increase revolutions per minute of the at least one propulsor when the processor calculates an increase in work exerted on the at least one fin, and to decrease the revolutions per minute of the at least one propulsor when the processor calculates a decrease in work exerted on the at least one fin; wherein work exerted by the user controls the revolutions per minute of the at least one propulsor.

9. The apparatus of claim 1 further comprising:

a proximity sensor engaged between said fin and said housing; and said proximity sensor senses the change in the distance between said fin and said housing; and a processor in said housing for calculating the work exerted on said at least one fin based on the change in the distance between said fin and said housing, by the equation:

$$F=R(S)$$

where F is force applied to said fin;

and R is the flexion of said fin; and

S is the change in the distance between said fin and said housing as measured by said proximity sensor; and an electronic speed controller; and said electronic speed controller is configured to decrease revolutions per minute of the at least one propulsor when the processor calculates an increase in work exerted on the at least one fin and to increase the revolutions per minute of the at least one propulsor when the processor calculates a decrease in work exerted on the at least one fin; wherein work exerted by the user controls the revolutions per minute of the at least one propulsor maintaining a relatively constant velocity.

10. The apparatus of claim 1 further comprising:

a proximity sensor engaged between said fin and said housing; and said proximity sensor senses the rate of change of the distance between said fin and said housing; and a processor in said housing for calculating the work exerted on said at least one fin based on the rate of change of the distance between said fin and said housing, by the equation:

$$F=R(S)$$

where F is force applied to said fin;

and R is the flexion of said fin; and

S is the rate of change of the distance between said fin and said housing as measured by said proximity sensor; and an electronic speed controller; and said electronic speed controller is configured to decrease revolutions per minute of the at least one propulsor when the processor calculates an increase in work exerted on the at least one fin and to increase the revolutions per minute of the at least one propulsor when the processor calculates a decrease in work exerted on the at least one fin; wherein work exerted by the user controls the revolutions per minute of the at least one propulsor maintaining a relatively constant velocity.

11. The apparatus of claim 1 further comprising:

a proximity sensor engaged between said fin and said housing; and said proximity sensor is, in combination, a magnet on said fin that communicates with a magnetic sensor in said housing; wherein the proximity sensor senses the change and rate of change of the distance between said magnet and said sensor; and a processor in said housing for calculating the work exerted on said at least one fin based on the change and rate of change of the distance between said magnet and said sensor, by the equation:

$$F=R(S)$$

where F is force applied to said fin;

and R is the flexion of said fin; and

S is the change and rate of change of the distance between said fin and said housing as measured by said proximity sensor; and an electronic speed controller; and said electronic speed controller is configured to increase revolutions per minute of the at least one propulsor when the processor calculates an increase in work exerted on the at least one fin; and to gradually decrease the revolutions per minute over time of the at least one propulsor, according to a preset time value, when the processor calculates a decrease in work exerted on the at least one fin; wherein work exerted by the user controls the revolutions per minute of the at least one propulsor.

12. The apparatus of claim 1 further comprising:

a strain gauge engaged between said fin and said housing; and said strain gauge senses the change in the strain on said at least one fin and said housing; and a processor in said housing for calculating the work exerted on said at least one fin based on the change in the strain on said at least one fin, by the equation:

$$F=R(S)$$

where F is force applied to said fin;

and R is the flexion of said fin; and

S is the change in the distance between said fin and said housing as measured by said proximity sensor; and an electronic speed controller; and said electronic speed controller is configured to increase revolutions per minute of the at least one propulsor when the processor calculates an increase in work exerted on the at least one fin; and to decrease the revolutions per minute of the at least one propulsor when the processor calculates a decrease in work exerted on the at least one fin; wherein increase in work exerted by the user increases the revolutions per minute of the at least one propulsor.

13. The apparatus of claim 1 further comprising:

a strain gauge engaged between said fin and said housing; and said strain gauge senses the change in the strain exerted on said at least one fin; and a processor in said housing for calculating the work exerted on said at least one fin based on the change in the strain on said fin, by the equation:

$$F=R(S)$$

where F is force applied to said fin;

and R is the flexion of said fin; and

S is the change in the distance between said fin and said housing as measured by said proximity sensor; and an electronic speed controller; and said electronic speed controller is configured to decrease revolutions per minute of the at least one propulsor when the processor calculates an increase in work exerted on the at least one fin; and to increase the revolutions per minute of the at least one propulsor when the processor calculates a decrease in work exerted on the at least one fin; wherein increased work exerted by the user decreases the revolutions per minute of the at least one propulsor maintaining a substantially constant velocity.

14. A method for controlling a propulsor on at least one fin coupled with a proximity sensor comprising:

a user interface for setting the sensitivity between the reading of a proximity sensor and the change in revolutions per minute of said propulsor; and information derived from user interface settings is converted to a non-transitory computer readable medium storing instructions; and said instructions are stored on memory electronically coupled with said propulsor; and said instructions query activity from said user interface; and when no activity from said user interface is confirmed, instructions from said stored memory control said propulsor; and when activity from said user interface is confirmed, information from said user interface is converted to a non-transitory computer-readable medium storing instructions to control said propulsor; and said instructions read information from said proximity sensor and calculate force on said fin by the equation:

$$F=R(S)$$

where F is force applied to said fin;

and R is the flexion of said fin; and

S is the change in the distance between said fin and said housing as measured by said proximity sensor; and said instructions convert change in force exerted on said fin to a change in revolutions per minute of said propulsor; and said instructions convert settings for the sensitivity between changes in proximity-sensor readings to changes in revolutions per minute of said propulsor; and said instructions wait a preset number of milliseconds and return to query activity from said user interface.

15. An apparatus of claim 14 further comprising:

memory storage electronically coupled with said propulsor; and a temperature sensor; and a pressure sensor; and a salinity sensor; and a clock; and said instructions record and store temperature, pressure, salinity and time readings from the environment surrounding said propulsor.

16. A method for controlling a propulsor on at least one fin coupled with a proximity sensor comprising:

a user interface for setting the decay after a reading showing no movement from the reading of a proximity sensor and the change in revolutions per minute of said propulsor; and information derived from user interface settings is converted to a non-transitory computer readable medium storing instructions; and said instructions are stored on memory electronically coupled with said propulsor; and said instructions query activity from said user interface; and when no activity from said user interface is confirmed, instructions from said stored memory control said propulsor; and when activity from said user interface is confirmed, information from said user interface is converted to a non-transitory computer-readable medium storing instructions to control said propulsor; and said instructions read information from said proximity sensor and calculate force on said fin by the equation:

$$F=R(S)$$

where F is force applied to said fin;

and R is the flexion of said fin; and

S is the change and rate of change of the distance between said fin and said housing as measured by said proximity sensor; and said instructions convert change in force exerted on said fin to a change in revolutions per minute of said propulsor; and said instructions convert settings for the decay after minimal proximity-sensor readings to changes in revolutions per minute of said propulsor; and said instructions wait a preset number of milliseconds and return to query activity from said user interface.

17. The apparatus of claim 16 further comprising:

memory storage electronically coupled with said propulsor; and a temperature sensor; and a pressure sensor; and a salinity sensor; and a clock; and said instructions record and store temperature, pressure, salinity and time readings from the environment surrounding said propulsor.

* * * * *